US006217621B1

(12) United States Patent
Modebelu et al.

(10) Patent No.: US 6,217,621 B1
(45) Date of Patent: Apr. 17, 2001

(54) TEXTILE SUBSTRATE DYE STRIPPING

(75) Inventors: Peter Modebelu, Randolph; Harrie Schoots, Melrose; Jeremy Ko, Chestnut Hill, all of MA (US)

(73) Assignee: Morton International Inc., Chicago, IL (US)

( * ) Notice: Subject to any disclaimer, the term of this patent is extended or adjusted under 35 U.S.C. 154(b) by 0 days.

(21) Appl. No.: 09/349,437

(22) Filed: Jul. 9, 1999

(51) Int. Cl.[7] ..... D06L 3/10

(52) U.S. Cl. ..... 8/102; 8/107; 8/109; 8/110; 8/115.69

(58) Field of Search ..... 8/102, 107, 109, 8/110, 115.69

(56) References Cited

U.S. PATENT DOCUMENTS

| | | | |
|---|---|---|---|
| 2,211,138 | * | 8/1940 | Lewis et al. . |
| 3,127,231 | * | 3/1964 | Neale et al. . |
| 3,167,515 | * | 1/1965 | Hinckley et al. . |
| 3,250,587 | * | 5/1966 | Gallagher et al. . |
| 3,933,676 | * | 1/1976 | Wade . |
| 4,919,755 | * | 4/1990 | Mansson . |
| 5,336,479 | | 8/1994 | Munroe ..... 423/515 |

OTHER PUBLICATIONS

Laszlo, Regneration of Dye Saturated Quaternized Cellulose by Bisulfite Borohydrede Peductron of Duo Azo Groups etc; CAPLUS ab 1997:267391, 1997.*

Cook, M. M.; *Chapter 2: Environmental Chemistry of Dyes and Pigments*; Reife, A. & Freeman, H.S., ed., (John Wiley & Sons; 1996).

Meyers, P.; Wang, D.; and Hache, M.; *DBI, a novel bleaching process for recycled fibers*; Proceedings–1999 TAPPI Papermakers Conferenece.

* cited by examiner

*Primary Examiner*—Margaret Einsmann
(74) *Attorney, Agent, or Firm*—Kenneth Crimaldi; Joanne P. Will

(57) ABSTRACT

Matrix-dyed textiles of cellulose acetate, cellulose triacetate, silk, wool, flax, nylon, acrylic, polyethylene terephthalate, cotton, and rayon are stripped of their dyes in a dye stripping system comprising a reducing agent in an aqueous bath produced by the reaction of a bisulfite with about 0.35% or less of a borohydride by weight of the textile. The borohydride may be added to an aqueous bath already containing the bisulfite and the textile or the borohydride and bisulfite may be mixed in an add tank and the mixture added to the aqueous bath. Chelating agents, sequestering agents, fire retardants, and odor scavengers are not needed. Reclaimed textiles having superior receptivity of a new dye are provided.

1 Claim, No Drawings

TEXTILE SUBSTRATE DYE STRIPPING

FIELD OF THE INVENTION

This invention relates to the removal of organic dye molecules from fiber matrices. More particularly, it relates to the combination of a borohydride and a bisulfite and their reaction instead of sodium dithionite, as conventionally used, in the process of stripping dyed textiles.

BACKGROUND OF THE INVENTION

The stripping of organic dye molecules from textiles (e.g., woven, non-woven, and knitted cloth, and yarn) is performed when, for example, a first dyeing is unlevel and the dye house operator wishes to remove it preparatory to a second dyeing. The dye does not merely cling to the surfaces of the textile fibers but is held in the amorphous regions of fiber matrices by ionic and covalent bonds as well as by van der Waal forces and hydrogen bonding. Sodium dithionite and thiourea dioxide (also known as form amidine sulfonic acid or FAS) are the leading dye stripping agents in the textile industry. Sodium dithionite (also known as sodium hydrosulfite or "hydro") is the most popular one and is most often used as a powder containing 70% by weight of the active material along with sodium carbonate as a fire retardant, a chelating agent such as EDTA or a sequestering agent such as STPP. The textile industry still suffers from many spontaneous fires and the concomitant emission of sulfur dioxide when the dithionite powder comes into contact with moisture. Although use of an aqueous solution of the dithionite is growing because of the health, flammability, storage, and handling problems involved with the use of the powder, the solution must be stored under an inert atmosphere in dedicated insulated tanks that must be refrigerated for long term storage. Despite those problems and the recognition that the dithionite powder is inefficient and unreliable, it has retained its standing as the preferred stripping and reducing agent.

In conventional practice, the textile is placed in an aqueous bath, the pH of the bath is adjusted according to the requirements of the particular kind of textile to be stripped (i.e., below 7.5 for acetate and from a minimum of 10.2 to about 12.3 for cotton), and the bath is then heated to about 90–160° F. before the dithionite powder is added. The stripping bath is then heated to 212° F. ("the boil") or as high as about 230° F. when a pressurized vessel is used. The stripping is continued at temperature for about 30 minutes or more, the bath is dropped, and the stripped textile is rinsed twice. Oftentimes, the procedure must be repeated to achieve the necessary dye stripping and color removal.

It is clear, therefore, that the industry needs a more efficient and more reliable stripping system that gives satisfactory color removal even when the temperature is below the boil and the stripping time is much less than the conventional 30 minutes.

SUMMARY OF THE INVENTION

It is an object of this invention, therefore, to provide a dye stripping system that is consistently better than one in which dithionite is a raw material at temperatures above and below the boil.

It is a related object of this invention to provide a dye stripping system that provides a reclaimed textile whose acceptance of a new dye is superior in comparison with the prior art.

It is a related object of this invention to provide a dye stripping system that results in shorter production cycle times, energy savings and less substrate degradation.

It is a related object of this invention to provide a dye stripping system that eliminates the need for high pressure stripping.

It is a related object of this invention to provide a dye stripping system that eliminates the need for the chelating agents, sequestering agents, fire retardants, odor scavengers commonly used as part of the dithionite system.

These and other objects of this invention which will apparent from the following description are achieved by a dye stripping and decolorizing system comprising an aqueous bath maintained at a temperature of from about 180° to about 230° F., a bisulfite having the formula $MHSO_3$ dissolved in said bath, a textile immersed in said bath, said textile being made from matrix-dyed fibers, and a reducing agent produced by the reaction at a pH of from about 4 to about 7.4 of said bisulfite with from about 0.09% to about 0.35%, by weight of the textile, of a borohydride having the formula $ZBH_4$; wherein M is sodium, potassium, or ammonium, and Z is sodium or potassium. The borohydride may be added to an aqueous bath already containing the bisulfite and the textile or the borohydride and bisulfite may be mixed in an add tank and the mixture added to the aqueous bath.

DETAILED DESCRIPTION OF THE INVENTION

For the purposes of this invention, textile means spun fibers, filamentary fibers, yarn, woven, non-woven, or knitted goods made from said fibers and selected from the group consisting of cellulose acetate, cellulose triacetate, silk, wool and other protein fibers, flax and other bast fibers, nylon and other polyamide fibers, acrylic, polyethylene terephthalate, and cotton and rayon fibers.

Dyes that may be removed from matrix-dyed textile fibers by the stripping system of this invention include acid dyes, basic dyes, direct dyes, mordant dyes, sulfur dyes, vat dyes, reactive dyes, and disperse dyes.

Fresh dithionite may be produced by the reaction between sodium borohydride and sodium bisulfite according to the equation:

$$BH_4^- + 8\,HSO_3 + H^+ \xrightarrow{pH\ 5-8} 4\,S_2O_4^{-2} + B(OH)_3 + 5\,H_2O.$$

The yield is somewhat less than 100% because of the competing reaction of the borohydride with water and other reactions but it is most often about 90% or better. The radical anion, $.SO_2$—, is a possible intermediate in the reaction, as has been suggested by M. M. Cook in *Environmental Chemistry of Dyes and Pigments*, pp 33–41; A. Reife and H. Freeman, ed.; (J. Wiley, 1996). It, also, is a very strong reducing agent. Although the exact mechanism of the reaction has not been fully characterized and this invention is in no way limited by any particular mechanism, said radical anion may act as a reducing agent in this invention along with the dithionite, some portion of the borohydride, and some portion of the bisulfite.

Preferably, the amount of borohydride used in this invention is from about 0.1 to about 0.3%, more preferably from about 0.1 to about 0.25%, still more preferably from about 0.1 to about 0.15%, of the textile weight or, as they say in the dye art, on the weight of the goods (owg).

An alkaline aqueous solution containing, by weight, 12% sodium borohydride and 40% sodium hydroxide is the preferred reagent for the purposes of this invention because of its availability and stability. Such an aqueous solution is available under the trademark BOROL from Morton International, Inc. The amount of such an aqueous solution for the purposes of this invention is from about 10% to about 30%, preferably no more than about 25%, by weight, of the amount of anhydrous dithionite recommended by suppliers for the conventional dye stripping procedures in the textile industry, which vary for each particular textile and dye. For example, the recommended amounts of the 70% active powder are: about 2% on weight of goods (owg) for acetate fibers; about 1.5% owg for flax; about 10% owg for cotton; and about 8–10% owg for rayon chenille. On a molar basis, the amount of dithionite produced from the borohydride bisulfite reaction is equal to or less than the recommended amount. A proportionate amount of potassium borohydride, also commercially available, may be used.

As indicated by the above equation, 8 moles of the bisulfite are required for each mole of the borohydride but it is preferred to use a stoichiometric excess of the bisulfite. It is particularly preferred to use up to about 10% excess bisulfite on a molar basis. Moreover, when the BOROL solution is used, the sodium hydroxide present therein (40% by weight) requires an additional 3.2 moles of the bisulfite for each mole of borohydride used. Thus, in that case, it is preferable to use up to a total of about 12 moles per mole of borohydride.

In a preferred embodiment of this invention, the borohydride and the bisulfite are mixed in an add tank at a pH of about 5–8, e.g., about 6.6, and the reaction mixture is added from the tank to the stripping bath. The pH of the stripping bath is maintained in a pH range from about 4 to about 7.4, preferably from about 4 to about 5.8, when cellulose acetate, triacetate, and rayon/acetate blends are being decolorized. Stripping baths for such fibers are prepared by adding the borohydride and bisulfite mixture to an aqueous acetic acid bath having a pH of about 3.5, thereby raising the pH. When the reaction mixture is added from the tank to a stripping bath for color fast cotton and rayon, however, the bath is maintained at a pH of from about 10.2 to about 12.

In another embodiment of this invention, the borohydride and the bisulfite are added separately to an aqueous bath in which the textile is immersed. Because cotton and rayon require a pH of at least about 10.2 and as high as about 12 for proper swelling of the fiber matrices to allow entry of the reducing chemicals, sodium hydroxide or some other equally basic material is used to raise the pH as in the prior art. The presence of 40% by weight of sodium hydroxide in the preferred alkaline aqueous solution of sodium borohydride in the system of this invention, however, lessens the need for auxiliary amounts of the caustic. A maximum pH of about 11.6 is preferred for the purposes of this invention.

Level stripping of the dye from the textile is achieved primarily by the use of an efficient stripping agent but it is aided by the use of a surfactant in the system of this invention whereby uniform wetting of the fibers is enhanced by lowering the surface tension of the bath water. The surfactant is preferably non-ionic or anionic, depending upon the textile, the auxiliaries used, and the class of dye being stripped.

At the completion of the stripping period, the bath is dropped and the textile is immersed in a rinse bath. In the case of the acetate fibers and the like, a hypo rinse containing a surfactant and about 1% sodium thiosulfate and another rinse with 0.5% oxalic acid and a surfactant are used to passivate any metals that may have been in the textile. When the stripping bath is basic as for cotton, rinsing with aqueous acetic acid is the preferred for neutralizing the water adhering to the textile. In either case, rinsing is repeated if necessary.

Although the stripping and decolorization of this invention may be conducted at the high temperatures of the prior art (i.e., 210–230° F.) and for as much as about 30 minutes or more at such temperatures, it is an advantage of the system of this invention that it operates as well as or better than the prior art systems when the stripping is done at from about 180 to about 200° F. and for periods of from about 10 to about 20 minutes while diminishing the degradation of fibers suffered in the prior art. Preferably, the stripping operation of this invention is completed in about 15 minutes or less.

Another advantage of the system of this invention is the elimination of the need for chelating agents, sequestering agents, fire retardants, and odor scavengers commonly used in the prior art systems which use dithionite powder as the stripping agent.

The present invention is illustrated and compared with the prior art in the following examples which are not intended to limit the invention or its scope in any manner. As used in the examples and throughout this specification, all parts and percentages are by weight unless otherwise indicated. In each example of this invention, the borohydride and the bisulfite are mixed in an add tank at a pH of about 6.6 and the reaction mixture is added to the bath containing the textile. The temperature and pH of the bath are as indicated. The yarn packages in the working examples and the corresponding comparative examples are taken from the same lot and have the same winding densities.

Example 1

Three packages of C-139 rayon chenille dyed to an allspice color and having a total weight of 2193 grams were mounted on a 5.24" steel tube in a laboratory scale machine and the machine was filled with 26 liters of water. Forty four grams (2% owg) of sodium hydroxide pellets and 21 grams (1% owg) of an anionic surfactant (TENGEL DH-44) were added and the bath was circulated through the packages for 10 minutes as it was heated before a solution of 54.8 grams of BOROL solution (6.6 grams, or 0.17 mole, of sodium borohydride) and 200.2 grams (1.05 moles) of sodium metabisulfite ($Na_2S_2O_5$) in 1.6 liters of water at 80–105° F. to obtain 2.1 moles of $NaHSO_3$. The temperature of the bath was ramped up at 9° F./min to 200° F. and the bath was circulated through the packages for 15 minutes; the exterior to interior circulation being reversed every 3 to 5 minutes. The hot bath was dropped and replaced with 26 liters of rinse water containing about 0.25% owg of acetic acid and about 1% owg of the TENGEL surfactant. The rinse bath was ramped up to 160° F. and circulated for 10 minutes, then dropped and the rinse cycle was repeated. The stripping of the yarn was level and the CIELab color values were as follows:

| | Dyed yarn | Stripped yarn |
|---|---|---|
| L* | 54.87 | 98.83 |
| a* | 6.99 | 3.91 |
| b* | 18.17 | 13.90. |
| ΔE | | 44.27 |
| DL* (Delta lightness) | | 43.96 |

Comparative Example 1

The general procedure of Example 1 was repeated except that the total weight of the packages was 2161 grams, 42 grams of sodium hydroxide and 21 grams of the surfactant were used in the initial bath and 169 grams of 70% active dithionite powder (118.3 grams or 0.68 mole of $Na_2S_2O_4$) containing EDTA were used in the hot bath. The stripping of the yarn was level and the CIELab color values were as follows:

| | Dyed yarn | Stripped yarn |
|---|---|---|
| L* | 54.87 | 94.65 |
| a* | 6.99 | 4.81 |
| b* | 18.17 | 19.24. |
| ΔE | | 39.87 |
| DL* (Delta lightness) | | 39.78 |

Lightness (L*), a number between 1 (black) and 100 (white) is the most important value for color stripping. The product of the inventive process is 4.2 units closer to white than the product of the comparative example. On the yellow-blue axis of color space, +b*is more yellow. Thus, the product of the comparative example is 5.3 units or about 38% yellower than the product of this invention.

Example 2

Stripouts of C-139 rayon chenille and mock chenille, each being a "heavy shade", were carried out in a Gaston County Package Dye production machine using 2.5% owg BOROL solution (0.3% of sodium borohydride) and 9.14% owg of sodium metabisulfite over the boil for minutes. The ramping up of the temperature in the machine was about 4° F./minute. Run and pull dyeing of the stripped yarns was then performed in the same machine.

Example 3

The general procedure of Example 1 was repeated except that the yarn was light aubergine, the weight of the yarn was 1993 grams, 39.3 grams of sodium hydroxide and 20 grams of the surfactant were used in the initial bath and 24.9 grams of BOROL solution (3 grams or 0.079 mole of sodium borohydride; 0.15% owg) and 90.9 grams (0.48 mole) of sodium metabisulfite were used in the hot bath; and the bath was circulated for 30 minutes. A level and acceptable stripout was achieved with no perceptible yellowness in the stripped chenille.

Comparative Example 2

The general procedure of Example 3 was repeated except that the total weight of the packages was 2052 grams, 41 grams of sodium hydroxide and 20 grams of the surfactant were used in the initial bath and 80 grams (3.9% owg) of 70% active dithionite powder (56 grams or 0.32 mole of $Na_2S_2O_4$) containing EDTA were used in the hot bath. After rinsing with the proportionate amounts of acid and surfactant, it was found that the inside of the package was unreduced. This was an unacceptable stripout.

Example 4

The general procedure of Example 3 was followed in a trial at a plant laboratory except that 1389 grams of a rose colored cotton slub was used; 111 grams (8% owg) of sodium hydroxide and 13.9 grams (1% owg) of the surfactant were used in the initial bath; 17.37 grams (12.4 mls) of BOROL solution (2.08 grams, 0.055 mole, 0.15% owg of sodium borohydride) and 63.34 grams (0.33 mole) of sodium metabisulfite were used in the hot bath. The rinses contained 1% owg of acetic acid and of the surfactant. The results of the stripping were very impressive to the laboratory manager.

Comparative Example 3

The general procedure of Example 4 was repeated except that 1734 grams of a lighter colored cotton slub was used; 138.7 grams (8% owg) of sodium hydroxide was used along with 17.3 grams of the surfactant in the initial bath; and 67.6 grams (3.9% owg) of 70% active dithionite powder containing EDTA (47.3 grams or 0.34 mole of $Na_2S_2O_4$) were used in the hot bath. The rinses contained 1% acetic acid and 1% of the surfactant owg. The stripout was unlevel and ineffective colorwise.

What is claimed is:

1. A method for stripping dye from textiles selected from the group consisting of cellulose acetate, triacetate, and rayon/acetate blends comprising the steps of: (a) preparing a bath comprising a reducing agent produced by the reaction of a bisulfite having the formula $MHSO_3$, with from about 0.09% to about 0.3% by weight of said textile, of $ZBH_4$, wherein Z is sodium or potassium, wherein M is sodium, potassium or ammonium, and wherein the bath is prepared using 8–12 moles of $MHSO_3$ per mole of $ZBH_4$; further provided that said reaction occurs at a pH of from about 5 to about 8; (b) adding said textiles to said bath, wherein said bath is at a temperature of 180°–230° F. and the pH is 4.0–7.4.

* * * * *